US007206001B1

(12) United States Patent
Crandall et al.

(10) Patent No.: US 7,206,001 B1
(45) Date of Patent: Apr. 17, 2007

(54) FRACTAL-DITHERING TECHNIQUE FOR IMAGE DISPLAY

(75) Inventors: Richard E Crandall, Portland, OR (US); Evan T Jones, Portland, CA (US); Jason Klivington, Portland, OR (US)

(73) Assignee: Apple Computer, Inc., Cupertino, CA (US)

( * ) Notice: Subject to any disclaimer, the term of this patent is extended or adjusted under 35 U.S.C. 154(b) by 0 days.

(21) Appl. No.: 10/874,796

(22) Filed: Jun. 22, 2004

(51) Int. Cl.
*G09G 5/02* (2006.01)

(52) U.S. Cl. ..... 345/596; 345/690

(58) Field of Classification Search ..... 345/690; 358/457

See application file for complete search history.

(56) References Cited

U.S. PATENT DOCUMENTS 5,553,200 A * 9/1996 Accad ..... 358/1.9
5,982,989 A * 11/1999 Broddin et al. ..... 358/1.9
6,424,431 B1 * 7/2002 Ulichney et al. ..... 358/1.9

* cited by examiner

*Primary Examiner*—Mark Zimmerman
*Assistant Examiner*—Kevin Xu
(74) *Attorney, Agent, or Firm*—Fenwick & West LLP

(57) ABSTRACT

Rapid dithering of an RGB image from a higher order to a lower order number of bits is provided while introducing fewer undesirable artifacts than are visible in conventional dithering technology. A compact, deterministic method enables the elimination of banding, for example as is seen in 24-bit monitors when viewing color images with greater color depth. A fractal dithering engine selects a threshold matrix appropriate for an input stream, and using the threshold matrix, dithers images of the input stream to output images having a lower order number of color bits. In one embodiment, the threshold matrix is obtained by traversing 2-by-2 sub-regions of an N-by-N matrix according to a traversal pattern, and then applying a reverse binary function to the values in the original matrix to yield the threshold matrix. The threshold matrix preferably tessellates the pixel plane, subject to certain constraints.

6 Claims, 3 Drawing Sheets

FRACTAL-DITHERING TECHNIQUE FOR IMAGE DISPLAY

BACKGROUND OF THE INVENTION

1. Field of the Invention

The present invention relates generally to display of computer graphics. In particular, the present invention is directed towards a dithering technique for quickly displaying images at reduced color depth without significant quality loss.

2. Description of the Related Art

There is frequently a need to display an image on a display device that has insufficient color depth to display the image at its original color level. For example, a computer capable of an eight-bit color map will not accurately render a 16-bit image; a computer with a 24-bit color depth cannot display an image with 48-bit color, etc.

One way of displaying such an image is to cut off the lower-order bits of each pixel in the image. This, however, leads to the well-known problem of Mach banding, in which the human eye exaggerates the contrast between two surfaces with different luminance, making the image look unattractive.

Another attempt at solving the problem is the use of blue noise filtering. This is a collection of techniques in which pixels of different color are placed in some random fashion, in such a way that low frequency noise is suppressed and one is left with high spatial frequencies in the placement of the different colors. However, this technique causes clumps and gaps which, while minimized, are typically still visible. Secondly, so-called error diffusion, where some statistic propagates lexicographically across the image is not local—that is, the dither algebra depends on the environment of the pixel, which can require looking at each pixel several times in addition to being computationally expensive. Blue noise filtering is an error diffusion technique in which the color error and pixel placement is randomly distributed over an image.

A need remains for a technique for efficiently dithering an image that results in a high quality output image and does not require extensive computational power.

SUMMARY OF THE INVENTION

The present invention enables rapid dithering of an RGB image from a higher order to a lower order number of bits while introducing fewer undesirable artifacts than are visible in conventional dithering technology. The present invention is compact and deterministic, and enables the elimination of banding, for example as is seen in 24-bit monitors when viewing color images with greater color depth.

A system of the present invention includes a fractal dithering engine, which selects a threshold matrix appropriate for an input stream, and using the threshold matrix, dithers images of the input stream to output images having a lower order number of color bits. In one embodiment, the threshold matrix is obtained by traversing 2-by-2 subregions of an N-by-N matrix according to a traversal pattern, and then applying a reverse binary function to the values in the original matrix to yield the threshold matrix. The threshold matrix preferably tessellates the pixel plane, subject to certain constraints.

In addition to a general algorithm for an N-by-N matrix, the present invention also includes an algorithm particularly suited for 48-bit input and 24-bit output.

Preferably, the present invention has no effect on standard 24-bit RGB input. That is, a channel at 24 bits is dithered to be itself. This allows, for example, a 48-bit image to be composited on top of a 24-bit background, while ensuring that the 24-bit background will not change regardless of the changes the dither makes to the 48-bit image.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

Figure 1:
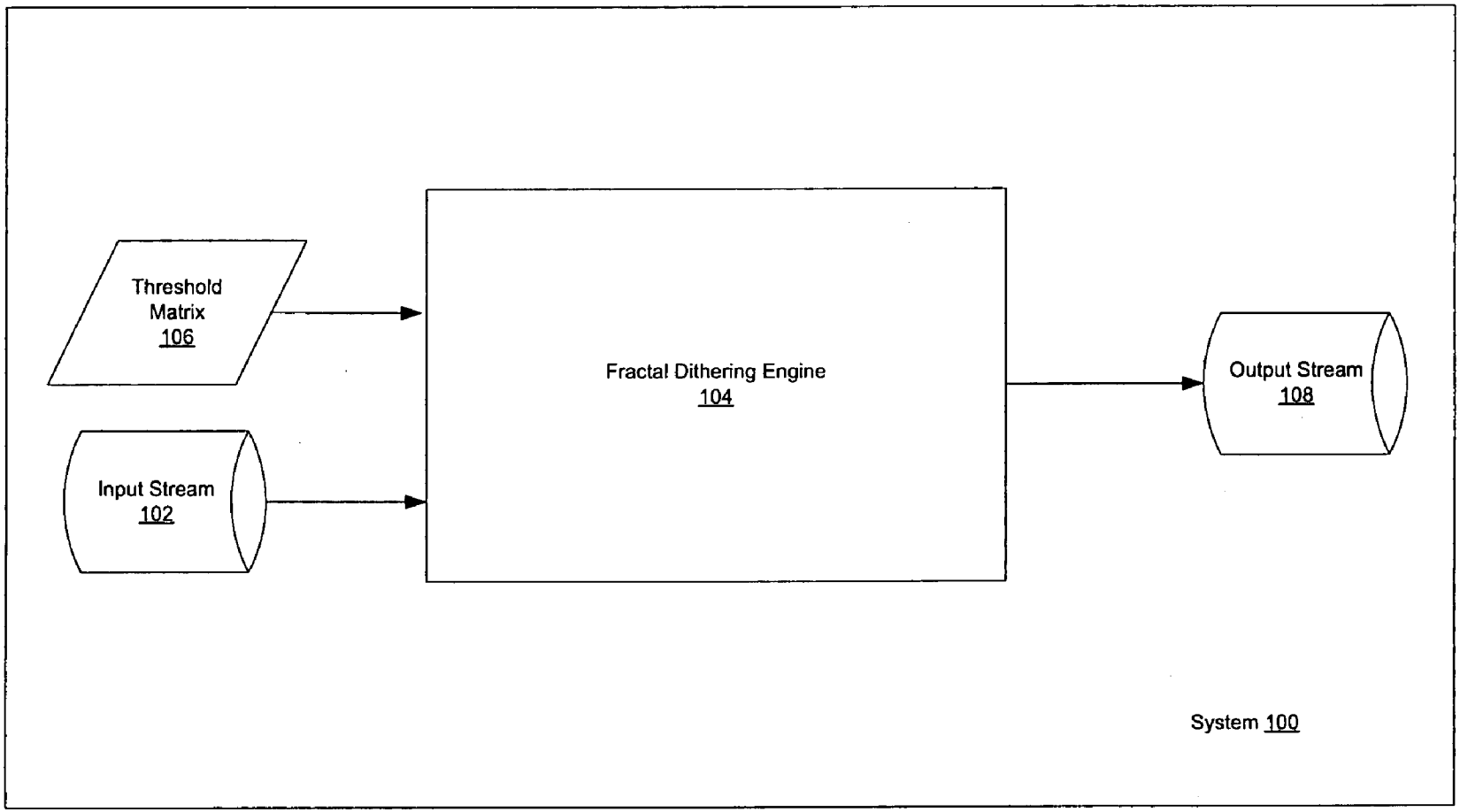
FIG. 1 is an illustration of a block diagram of a system in accordance with an embodiment of the present invention.

Referring now to FIG. 1, there is shown a block diagram of a system 100 in accordance with an embodiment of the present invention. System 100 includes a fractal dithering engine 104, which takes as input an input stream 102 and a threshold matrix 106, and produces an output stream 108. Images in the input stream 102 have a high order of color bits and fractal dithering engine 104 creates a stream 108 of dithered images having a lower order of color bits. The selection of an appropriate threshold matrix is detailed further below.

Using a Threshold Matrix

When dithering using a two-by-two threshold matrix represented by A, for a gray level g—a real number in (0, 1)—a pixel $p_{xy}$ at location (x, y) is turned on, e.g., to white, when $$A_{xy}<\text{Round}(4g),$$

where the entire pixel plane is tesselated by A. In this way, (x,y,g) determines a white or black value depending on the Round inequality, so that regions of grey level g have some pixels turned on and some pixels turned off. In practice, one actually tests inequality for $A_{x \bmod 2, y \bmod 2}$, because the matrix tessellates the plane. Such a prescription involving Round can be shown via standard Lloyd-Max theory to minimize the RMS error due to the dither. For example, for gray level g=½, only the 0 and 1 matrix elements are activated—giving an exact checkerboard dither, as tight as can be for such a g at exact midlevel.

Determining a Threshold Matrix

Each matrix of size $2^N$-by-$2^N$ can be conceptualized as comprising four smaller matrices of size $2^{N-1}$-by-$2^{N-1}$. In a recursive fashion, each matrix can therefore be said to comprise some number ($4^{N-1}$) of 2-by-2 matrices. A threshold matrix of size $2^N$-by-$2^N$ is preferably determined as follows:

Given a starting index value s, a 2-by-2 matrix is assigned the following entries:

$$\begin{pmatrix} s & s+3 \\ s+1 & s+2 \end{pmatrix}$$

Given a starting index value t, a 4-by-4 matrix is assigned entries by assigning entries to its four constituent 2-by-2 matrices. The four 2-by-2 matrices are assigned s values of t, t+4, t+8 and t+12, respectively, with increasing s values allocated to the constituent 2-by-2 matrices according to the same traversal pattern in which the entries of the 2-by-2 matrices increase. In the example above, that direction is down, to the right, and up. Propagating this pattern to the 4-by-4 matrix yields the following:

$$\begin{pmatrix} s & s+3 & s+12 & s+15 \\ s+1 & s+2 & s+13 & s+14 \\ s+4 & s+7 & s+8 & s+11 \\ s+5 & s+6 & s+9 & s+10 \end{pmatrix}$$

By extension, in the general case a matrix can have its cell contents allocated by allocating the sub-matrices contained within it, recursively reducing the size of the matrix until it is a 2-by-2 matrix and beginning the allocation with an appropriate s value. Each sub-matrix is visited according to the established traversal pattern. For example, for a $2^N$-by-$2^N$ matrix, matrix cell values are allocated first to the top-left $2^{N-1}$-by-$2^{N-1}$ sub-matrix, then to the bottom-left, then to the bottom-right, and finally to the top-right.

Although in a preferred embodiment the direction of travel, as described above, is from the top-left, down, to the right, and up (such as in the shape of the English letter "U"), other traversal patterns can be selected in other embodiments. In each case, the direction of traversal of matrices is preferably the same as the direction of increasing index value within a 2-by-2 matrix.

Figure 2:
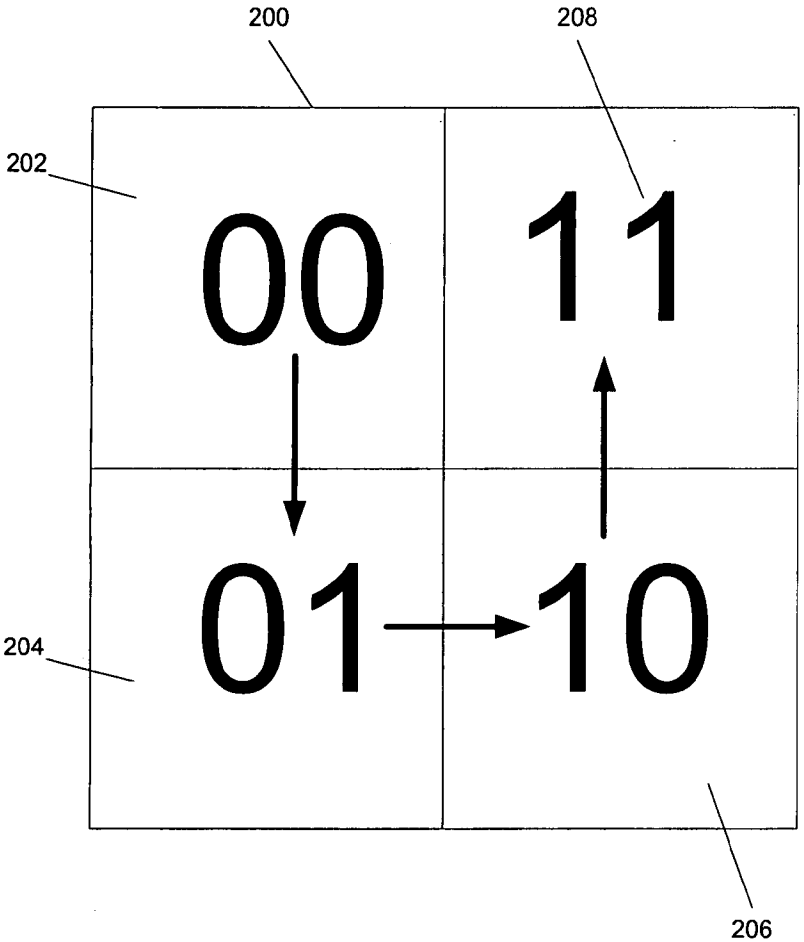
FIG. 2 illustrates a traversal pattern of a matrix in accordance with an embodiment of the present invention.

After each cell has been visited and assigned an initial value, a function rev(n, b) is applied, which reverses the last b bits of n. Applying the rev function to the cells of the 2-by-2 matrix 200 depicted in FIG. 2 yields the following results:

$$rev(00_2,2)=0,$$

$$rev(01_2,2)=2,$$

$$rev(10_2,2)=1$$

$$rev(11_2,2)=3.$$

Figure 3:
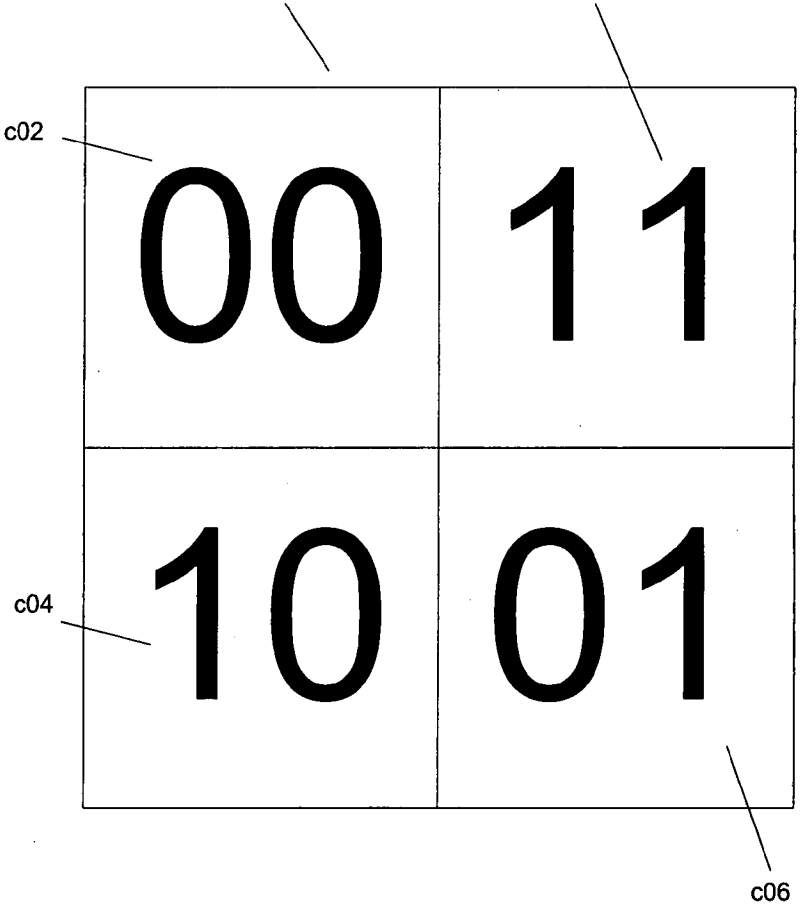
FIG. 3 illustrates an example of a two-by-two threshold matrix in accordance with an embodiment of the present invention.

As can be seen in FIG. 3, entry 202 is assigned the binary value 00; 204 is 10; 206 is 01 and 208 is 11.

Consider, by way of example, the determination of a 4-by-4 threshold matrix in accordance with an embodiment of the present invention as described above. Begin with a 4-by-4 matrix, and number its constituent 2-by-2 matrices by traversing them in the pattern described above, which yields:

$$\begin{pmatrix} 0 & 3 & 12 & 15 \\ 1 & 2 & 13 & 14 \\ 4 & 7 & 8 & 11 \\ 5 & 6 & 9 & 10 \end{pmatrix}$$

expressed in 4-bit binary representation, the above matrix becomes:

$$\begin{pmatrix} 0000 & 0011 & 1100 & 1111 \\ 0001 & 0010 & 1101 & 1110 \\ 0100 & 0111 & 1000 & 1011 \\ 0101 & 0110 & 1001 & 1010 \end{pmatrix}.$$

Next, reverse the bits of each entry to obtain:

$$\begin{pmatrix} 0000 & 1100 & 0011 & 1111 \\ 1000 & 0100 & 1011 & 0111 \\ 0010 & 1110 & 0001 & 1101 \\ 1010 & 0110 & 1001 & 0101 \end{pmatrix}.$$

Translating back to base 10:

$$A = \begin{pmatrix} 0 & 12 & 3 & 15 \\ 8 & 4 & 11 & 7 \\ 2 & 14 & 1 & 13 \\ 10 & 6 & 9 & 5 \end{pmatrix},$$

which is a 4-by-4 threshold matrix in accordance with the present invention.

An algorithm to obtain a $4^k$-by-$4^k$ matrix A can be described as follows. Assume the matrix A is N-by-N matrix, with $N=4^k$ for sake of illustration. Recall the bit-reversal function rev( ) described above. Denote by $x_j$ the j-th bit of x, so that $x=(\ldots x_2x_1x_0)_2$, and establish a Gray-order function, as gray(n)=n XOR (n>>1).

Next, the entries of matrix A are filled with values determined according to the following loop:

```
for(x=0; x<N; x++){
  for(y=0; y<N; y++){
  for(j=0; j<2k−1; j++){
    r_j :=gray(2·x_j+y_i);
    A_xy :=rev(Σ_{j=0}^{2k−1} r_j 4^j,2log_2 N);
  }
  }
}
```

Note that A preferably tessellates the entire pixel plane, so that the actual access of matrix elements will be of $A_{x \bmod N, y \bmod N}$. Following completion the loop, A is returned.

Figure 4:
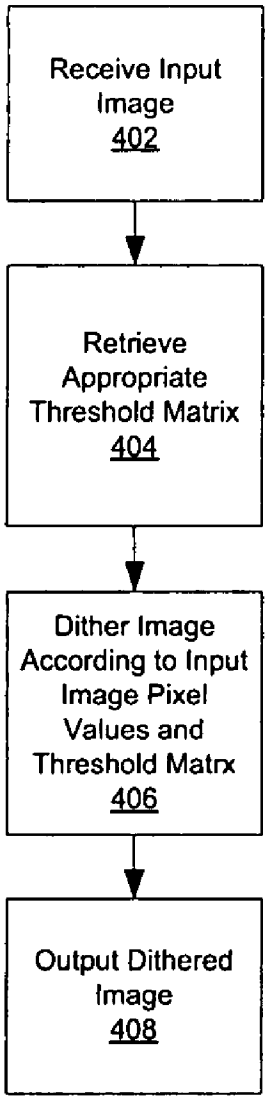
FIG. 4 is a flow chart of a method for dithering an image in accordance with an embodiment of the present invention.

Referring now to FIG. 4, there is a flowchart illustrating a method for dithering images in accordance with an embodiment of the present invention. System 100 receives 402 an input image that is to be dithered. Based on an empirical determination related to visual quality, and in one embodiment a four-by-four matrix, an appropriate threshold matrix 106 is retrieved 404 by fractal dithering engine 104. Using the threshold matrix values and the pixel values in the input stream 102, fractal dithering engine 104 dithers 406 the image by evaluting the pixel values against the threshold matrix values to determine whether each pixel should be illuminated. Finally, the resulting dithered image 108 is output 408 from fractal dithering engine 104.

48-Bit to 24-Bit Dithering

The above algorithm provides a solution in the general case for an N-by-N matrix. In the specific case of 48-bit RGB input that is to be displayed with 24-bit RGB output, the following algorithm can be used by system 100. When a 16-bit color channel c, which may be a red (R), green (G), or blue (B) channel, has "excess value", $e \in [0,255]$, defined as $$e := c \bmod 256,$$

define a coordinate-dependent bit:

$$B(x,y)=1 \text{ if } A_{x\%4,y\%4} < \lfloor e/16 \rfloor$$

$$B(x,y)=1 \text{ if } A_{x\%4,y\%4} = \lfloor e/16 \rfloor \text{ and } R(x,y) < e\%16, \text{ and}$$

$$B(x,y)=0 \text{ otherwise}$$

where R(x, y) is a suitable function with values in [0,15]. This avoids the need to use a 16-by-16 matrix as would be used by the general algorithm described above. Instead, a 2-by-2 matrix can be used, choosing R to be a random function (equally distributed), or in an alternative embodiment, different scalings of the pixel plane can be used to access R values from the matrix itself. For each 16-bit color channel $c \in \{r, g, b\}$, do:

$$c_{low} = c >> 8;$$

$$c_{high} = (c_{low}+1) - (c_{low} >> 8);$$

$$e_c = c \& 255.$$

The color channel at (x, y) is then set to the 8-bit value $$c'(x,y) = c_{low}(1 - B(x,y,e_c)) + c_{high} B(x,y,e_c).$$

Note that using the above algorithm, pixel neighborhood becomes irrelevant, since only point(x, y) is input. The dither is entirely deterministic and point-local. Note also that a stream of 48-bit color values can be jammed in the respective high-bytes with the dithered channel values. In addition, original 24-bit colors (having channels c=(byte) 00000000 will be dithered just to the value (byte). This means that for 24-bit color originals, nothing is perturbed by the algorithm.

The present invention has been described in particular detail with respect to a limited number of embodiments. Those of skill in the art will appreciate that the invention may additionally be practiced in other embodiments. First, the particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead performed by a single component. For example, the particular functions of the fractal dithering engine 104 and so forth may be provided in many or one module.

Some portions of the above description present the feature of the present invention in terms of algorithms and symbolic representations of operations on information. These algorithmic descriptions and representations are the means used by those skilled in the computer graphics arts to most effectively convey the substance of their work to others skilled in the art. These operations, while described functionally or logically, are understood to be implemented by computer programs. Furthermore, it has also proven convenient at times, to refer to these arrangements of operations as modules or code devices, without loss of generality.

It should be borne in mind, however, that all of these and similar terms are to be associated with the appropriate physical quantities and are merely convenient labels applied to these quantities. Unless specifically stated otherwise as apparent from the present discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by real time network operating systems.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description above. In addition, the present invention is not described with reference to any particular programming language. It is appreciated that a variety of programming languages may be used to implement the teachings of the present invention as described herein, and any references to specific languages are provided for disclosure of enablement and best mode of the present invention.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention.

We claim:

1. A method for dithering an image having a plurality of 16-bit color channel pixel planes, each pixel plane having a plurality of pixels, each pixel having a 16-bit value, the method comprising:

for each pixel, dividing the pixel value into a first portion including the 8 most-significant bits of the pixel value and a second portion including the 8 least-significant bits of the pixel value channel;

dividing the bits of the second portion into a third portion, including the 4 most-significant bits of the second portion, and a fourth portion, including the 4 least-significant bits of the second portion;

comparing the bits of the third portion to a first entry in a 4-by-4 matrix A, accessed by $A_{x\%4,y\%4}$; where x and y represent coordinates of the pixel within the pixel plane;

responsive to the bits of the third portion being greater than the first entry in the matrix, incrementing the value of the first portion of the pixel value;

responsive to the bits of the third portion equaling the first entry in the matrix:

comparing the bits of the fourth portion to a second entry in the matrix A, accessed by a different scaling of the pixel plane; and responsive to the bits of the fourth portion being greater than the second entry, incrementing the value of the first portion of the pixel value.

2. The method of claim 1 further comprising:

rendering the dithered image by, for each pixel, rendering the bits of the first portion of the pixel value.

3. A system for dithering an image, the image having a plurality of 16-bit color channel pixel planes, each pixel plane having a plurality of pixels, each pixel having a 16-bit value, the system comprising:

a fractal dithering engine adapted to receive an input stream including the image to be dithered, and for each pixel, further adapted to:

divide the pixel value into a first portion including the 8 most-significant bits of the pixel value and a second portion including the 8 least-significant bits of the pixel value channel;

divide the bits of the second portion into a third portion, including the 4 most-significant bits of the second portion, and a fourth portion, including the 4 least-significant bits of the second portion;

compare the bits of the third portion to a first entry in a 4-by-4 matrix A, accessed by $A_{x\%4,y\%4}$; where x and y represent coordinates of the pixel within the pixel plane;

responsive to the bits of the third portion being greater than the first entry in the matrix, to increment the value of the first portion of the pixel value;

responsive to the bits of the third portion equaling the first entry in the matrix:

to compare the bits of the fourth portion to a second entry in the matrix A, accessed by a different scaling of the pixel plane; and responsive to the bits of the fourth portion being greater than the second entry, to increment the value of the first portion of the pixel value.

4. The system of claim 3, wherein the fractal dithering engine is further configured to render the dithered image by, for each pixel, rendering the bits of the first portion of the pixel value.

5. A computer program product for dithering an image having a plurality of 16-bit color channel pixel planes, each pixel plane having a plurality of pixels, each pixel having a 16-bit value, the computer program product stored on a computer readable medium and including code for causing a computer to carry out the steps of:

for each pixel, dividing the pixel value into a first portion including the 8 most-significant bits of the pixel value and a second portion including the 8 least-significant bits of the pixel value channel;

dividing the bits of the second portion into a third portion, including the 4 most-significant bits of the second portion, and a fourth portion, including the 4 least-significant bits of the second portion;

comparing the bits of the third portion to a first entry in a 4-by-4 matrix A, accessed by $A_{x\%4,y\%4}$; where x and y represent coordinates of the pixel within the pixel plane;

responsive to the bits of the third portion being greater than the first entry in the matrix, incrementing the value of the first portion of the pixel value;

responsive to the bits of the third portion equaling the first entry in the matrix:

comparing the bits of the fourth portion to a second entry in the matrix A, accessed by a different scaling of the pixel plane; and responsive to the bits of the fourth portion being greater than the second entry, incrementing the value of the first portion of the pixel value.

6. The computer program product of claim 5 further comprising code to cause a computer to carry out the step of rendering the dithered image by, for each pixel, rendering the bits of the first portion of the pixel value.

* * * * *